US008406653B2

(12) United States Patent
Okamoto

(10) Patent No.: US 8,406,653 B2
(45) Date of Patent: Mar. 26, 2013

(54) IMAGE FORMING APPARATUS

(75) Inventor: Masaya Okamoto, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 339 days.

(21) Appl. No.: 12/913,564

(22) Filed: Oct. 27, 2010

(65) Prior Publication Data

US 2011/0229192 A1 Sep. 22, 2011

(30) Foreign Application Priority Data

Mar. 16, 2010 (JP) ..... 2010-059124

(51) Int. Cl.
*G03G 15/00* (2006.01)

(52) U.S. Cl. ..... 399/110; 399/123; 399/358; 399/360

(58) Field of Classification Search ..... 399/110, 399/111, 113, 119, 120, 123, 257, 358, 360
See application file for complete search history.

(56) References Cited

U.S. PATENT DOCUMENTS 4,032,229 A * 6/1977 Tani et al. ..... 399/348
7,155,148 B2 * 12/2006 Nishimura et al. ..... 399/257
2005/0100354 A1 5/2005 Nishimura et al.

FOREIGN PATENT DOCUMENTS

JP 9-325662 A 12/1997
JP 10-153933 A 6/1998
JP 2005-141096 A 6/2005

* cited by examiner

*Primary Examiner* — Hoang Ngo
(74) *Attorney, Agent, or Firm* — Sughrue Mion, PLLC

(57) ABSTRACT

An image-forming apparatus comprises: a body having a mount/remove opening; a removable component that can be mounted on or removed from the body via the mount/remove opening, the removable component being operable when mounted on the body; a door attached to the mount/remove opening; a mounting unit, on which the removable component is mounted, attached to the body; a connecting member that connects the door and the mounting unit, a position or attitude of the mounting unit in accordance with an opening/closing operation of the door, causes the removable component to move to a first position in which the removable component is operable when the door is closed, and causes the removable component mounted on the mounting unit to move to a second position, which is more easily accessible when the door is opened.

9 Claims, 12 Drawing Sheets

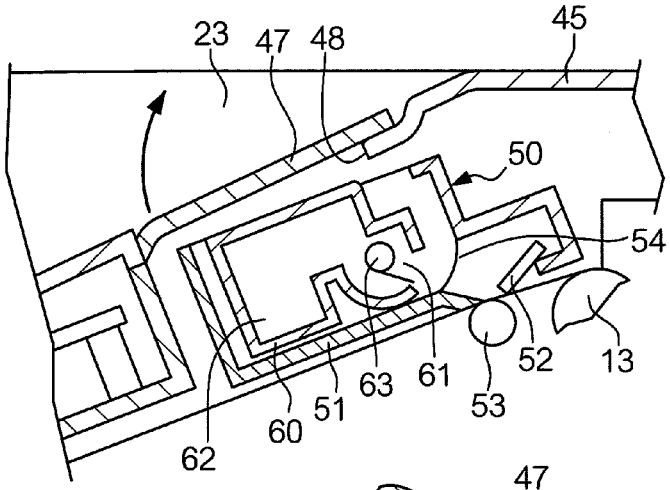
FIG. 5A
FIG. 5B
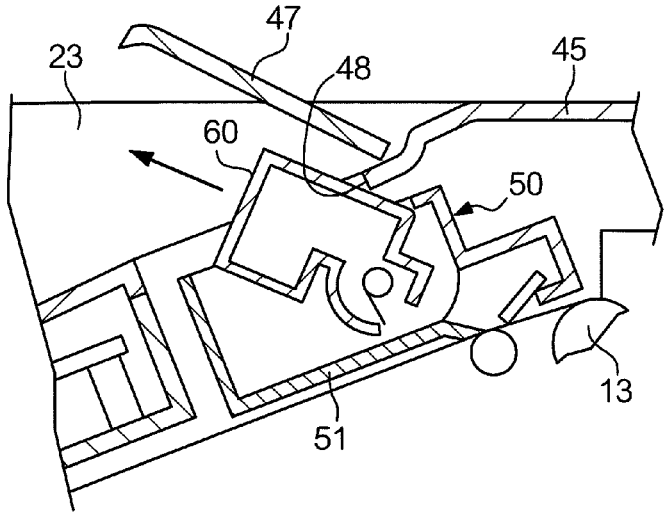
FIG. 5C
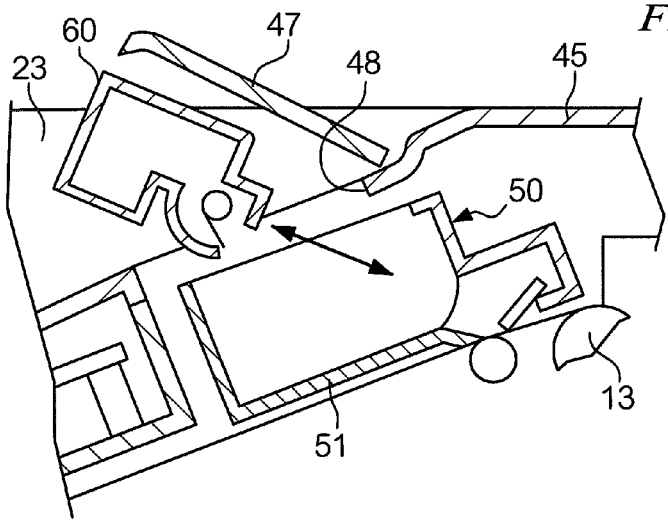

IMAGE FORMING APPARATUS

CROSS-REFERENCE TO RELATED APPLICATIONS

This application is based on and claims priority under 35 U.S.C. 119 from Japanese Patent Application No. 2010-59124, which was filed on Mar. 16, 2010.

TECHNICAL FIELD

The present invention relates to image-forming apparatuses.

RELATED ART

There are known in the art electrophotographic image-forming apparatuses that are provided with structures for removal of excess developing agent. Such a structure may be configured such that upon a first transfer of an image from an image holding member to a recording medium (media sheet), or upon a second transfer of the image from an intermediate transfer member to a recording medium excess developing agent, mainly toner, is removed from the image holding member or the intermediate transfer member by use of a cleaning device, and recovered to a removable recovery container. In such an image-forming apparatus, once the recovery container is full it is removed and replaced with another removable recovery container, which replacement container is mounted to the image holding member in place of the removed recovery container.

SUMMARY

According to an aspect of the present invention, there is provided an image-forming apparatus including: a body having a mount/remove opening; a removable component that can be mounted on or removed from the body via the mount/remove opening, the removable component being operable when mounted on the body; a door attached to the mount/remove opening; a mounting unit on which the removable component is mounted, the mounting unit being attached to the body; a connecting member that connects the door and the mounting unit, changes at least one of a position and attitude of the mounting unit in accordance with an opening/closing operation of the door, causes the removable component mounted on the mounting unit to move to a first position in which the removable component is operable when the door is closed, and causes the removable component mounted on the mounting unit to move to a second position, which is more easily accessible from an external space via the mount/remove opening than the first position, when the door is opened.

BRIEF DESCRIPTION OF THE DRAWINGS

Exemplary embodiments of the present invention will be described in detail based on the following figures, wherein:

FIGS. 5A, 5B, and 5C are drawings schematically showing configurations and operation states of a toner recovery unit;

DETAILED DESCRIPTION

1. Exemplary Embodiment

Figure 1:
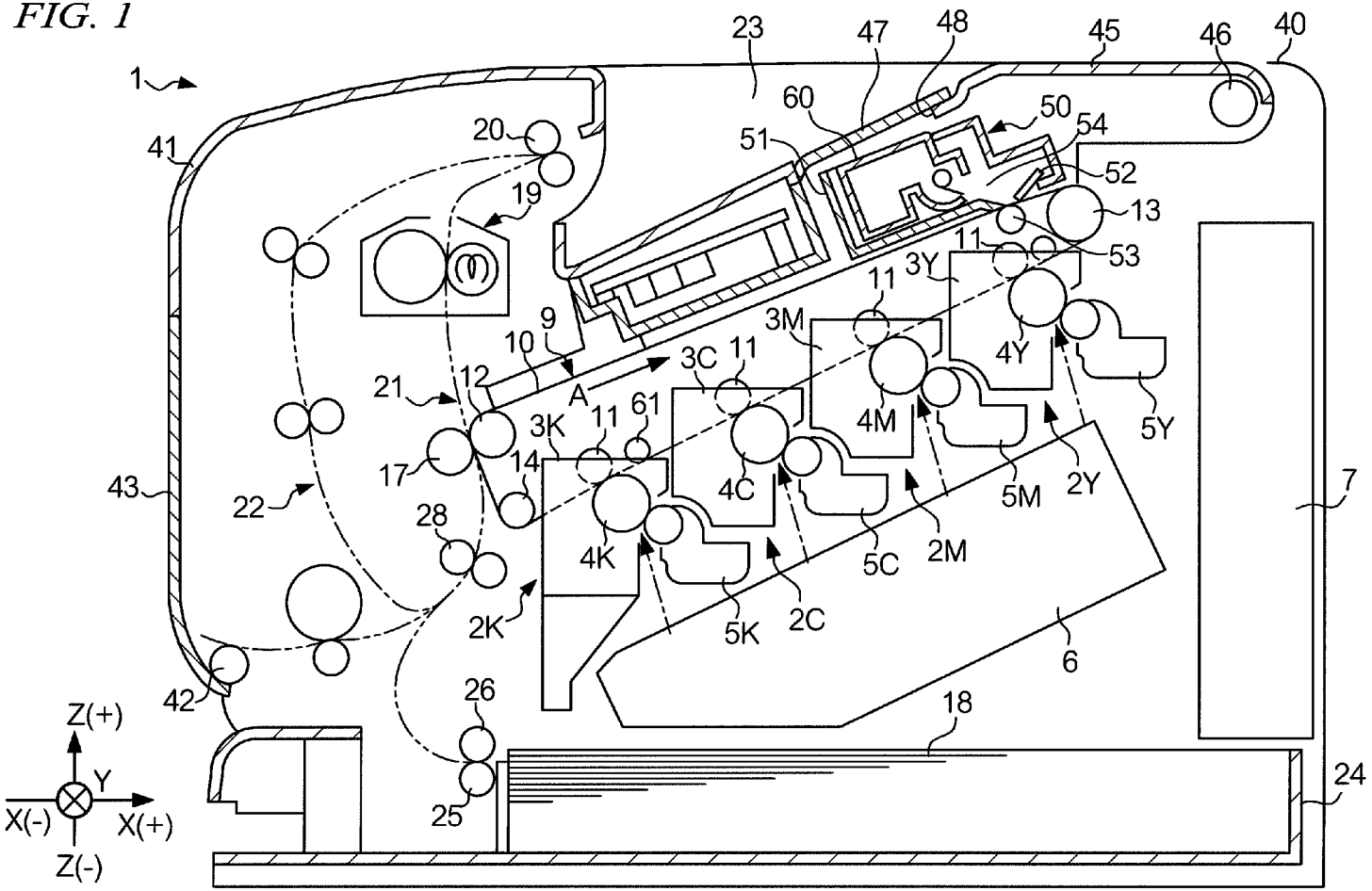
FIG. 1 is a diagram schematically showing a structure of an image-forming apparatus according to an exemplary embodiment of the present invention.

In this exemplary embodiment, description will be made by taking an electrophotographic image-forming apparatus such as a printer, a copy machine, or a facsimile machine as an example. FIG. 1 is a diagram schematically showing a structure of an image-forming apparatus according to an exemplary embodiment of the present invention. In the following, description is given of image-forming apparatus 1 as viewed from the front of the apparatus, where the horizontal direction is denoted as the X-axis direction, with right/left directions from a viewer's perspective being indicated by X(+) and X(−), respectively; the front-back direction of image-forming apparatus 1 is denoted as the X-axis direction, with back/front directions of image-forming apparatus 1 being indicated by Y(+) and Y(−), respectively; and the vertical direction is denoted as the Z-axis direction, with up/down directions being indicated by Z(+) and Z(−), respectively.

<Configuration of Image-Forming Apparatus>

The image-forming apparatus is provided with four image-forming units 2Y for yellow (Y), 2M for magenta (M), 2C for cyan (C), and 2K for black (K) in parallel along an intermediate transfer belt, as well as a control unit that controls the overall operation of image-forming apparatus 1, an image processing device (not shown) for performing image processing on image data sent through a scanner and a personal computer (which are not shown in the figure), or through a telephone line and the like. These image-forming units 2Y, 2M, 2C, and 2K are arranged in parallel with fixed gaps therebetween in such a way that image-forming unit 2Y for yellow (Y), which is firstly transferred onto an intermediate transfer belt, is disposed at the highest position and image-forming unit 2K for black (K), which is lastly transferred onto the intermediate transfer belt, is disposed at the lowest position. In other words, they are disposed in a line forming an angle relative to the horizontal (for example, 20 degrees relative to the horizontal). As a result of these four image-forming units 2Y, 2M, 2C, and 2K being disposed in such a line forming an angle relative to the horizontal, the distance between image-forming unit 2Y and image-forming unit 2K along the width of image-forming apparatus 1 (in the direction X) is shorter than that in the case where these four image-forming units 2Y, 2M, 2C, and 2K are disposed horizontally.

These four image-forming units 2Y, 2M, 2C, and 2K have basically the same structure, and therefore, in the following description, they will each be referred to as image-forming unit 2, when it is not necessary to distinguish between them.

Image-forming unit 2 includes a photo-conductor unit 3 that is equipped with a photoconductor drum 4 serving as an image holding body, a charging device and the like, and a developing device 5. The developing devices 5Y, 5M, 5C, and 5K are attached to body 40 through a frame (not shown), and gaps between the developing devices 5Y, 5M, 5C, and 5K are unit housing sections on which photoconductor units 3 are mounted. In addition, each photoconductor unit 3 is removable from the body.

An image exposing device 6 that is commonly used for image-forming units 2Y, 2M, 2C, and 2K is provided under image-forming units 2Y, 2M, 2C, and 2K. This image-exposing device 6 is equipped with four semiconductor lasers (not shown) that irradiate laser beams individually modulated in accordance with image data of Y, M, C, and K colors. The four laser beams irradiated from these semiconductor lasers are polarized by polygon mirrors, and through lenses and mirrors (none of which are shown), they scan surfaces of photoconductor drums 4 of image-forming units 2Y, 2M, 2C, and 2K respectively and write electrostatic latent images onto the surfaces thereof. The electrostatic latent images written onto the surfaces of photoconductor drums 4 are developed by developing devices 5Y, 5M, 5C, and 5K by the use of developers including corresponding color toners, with the result that four toner images are generated. The four color toner images that are sequentially generated on photoconductor drums 4 of image-forming units 2Y, 2M, 2C, and 2K are overlappingly transferred by corresponding first transfer rollers 11 onto the lower outer peripheral surface of intermediate transfer belt 10 that is disposed above image-forming units 2Y, 2M, 2C, and 2K as an intermediate transfer member. In addition, a power supply unit 7 for supplying power to various units and sections is provided in a right corner of body 40.

Intermediate transfer belt 10 is an endless belt member that is driven and supported by plural rollers such as drive roller 12, tension roller 13, and idler roller 14. Intermediate transfer belt 10 is cyclically driven in the direction indicated by arrow A by drive roller 12 that is rotationally driven by a drive motor (not shown). This intermediate transfer belt 10 is disposed on a slant forming a certain angle relative to the horizontal in such a way that, on the lower base of intermediate transfer belt 10, the downstream side in the direction of travel of intermediate transfer belt 10 is vertically lower, and the upstream side is vertically higher. In the above-mentioned lower base, intermediate transfer belt 10 makes contact with photoconductor drums 4Y, 4M, 4C, and 4K of image-forming units 2Y, 2M, 2C, and 2K. As this intermediate transfer belt 10, for example, a belt made of synthetic resin film having flexibility such as polyimide resin film, both end of which are connected to each other by adhesion or other means to make an endless belt, is used.

Intermediate transfer belt 10, first transfer rollers 11, drive roller 12, tension roller 13, idler roller 14, and the like constitute intermediate transfer member 9.

Recording sheets 18 of a recognized standard size and quality are fed as recording media from paper container 24 disposed inside image-forming apparatus 1 along feeding route 21 formed by plural pairs of rollers. Along this feeding route 21, the recording sheets 18 from paper container 24 are fed to resist roller 28 one by one by sheet-feeding roller 25 and sheet-separating/feeding roller 26, and they stop moving once at resist roller 28. Next, these recording sheets 18 are fed to a second transfer position of intermediate transfer belt 10 by resist roller 28 that is rotationally driven at a predetermined timing. At the second transfer position there is provided second transfer roller 17 on one side of intermediate transfer belt 10 and in opposing relation to drive roller 12 provided on the other side of intermediate transfer belt 10. Second transfer roller 17 rotates in a direction opposite to that of drive roller 12 and presses each recording sheet 18 against intermediate transfer belt 10 as the sheet moves between the rollers. Toner images of yellow (Y), magenta (M), cyan (C), and black (K) provided in overlapping relation on intermediate transfer belt 10 are transferred onto recording sheet 18 under pressure of second transfer roller 17 and action of electrostatic force. After heat and pressure are applied to recording sheets 18, onto which the four color toner images have been transferred through the second transfer, by a fixing device 19 as a fixing process, recording sheets 18 are discharged by a discharge roller 20 onto sheet discharge section 23 prepared in the upper part of image-forming apparatus 1. In addition, feeding route 21 is provided with a reversal mechanism 22 that turns over recording sheets 18 so as to transpose the obverse and the reverse sides of recording sheets 18.

Image-forming apparatus 1 is provided with a switching mechanism that switches between a monochromatic mode and a color mode to reduce power consumption. In the chromatic mode, image-forming apparatus 1 forms monochromatic images using, for example, only black toner. On the other hand, in the color mode, image-forming apparatus 1 forms color images using plural color toners.

The control unit switches between the monochromatic mode, in which images are formed using only black toner, and the color mode, in which images are formed using yellow, magenta, cyan, and black toners, in accordance with a user's operation at an operation unit 49 and the like. In this case, the control unit changes the attitude of intermediate transfer member 9 according to the currently used mode, controls the arrangements of image-forming units 2 and the like, and forms images on recording sheets 18. In other words, the attitude of intermediate transfer member 9 is equivalent to the orientation of intermediate transfer belt 10, or is equivalent to a relation between the longitudinal direction of intermediate transfer belt 10 and the direction in which photoconductor drums 4 are arranged. One method for switching between these two modes is to use a spacing section that makes gaps between this intermediate transfer belt 10 and photoconductor drums 4C, 4M, 4Y by moving the position of intermediate transfer belt 10.

Figure 2A:
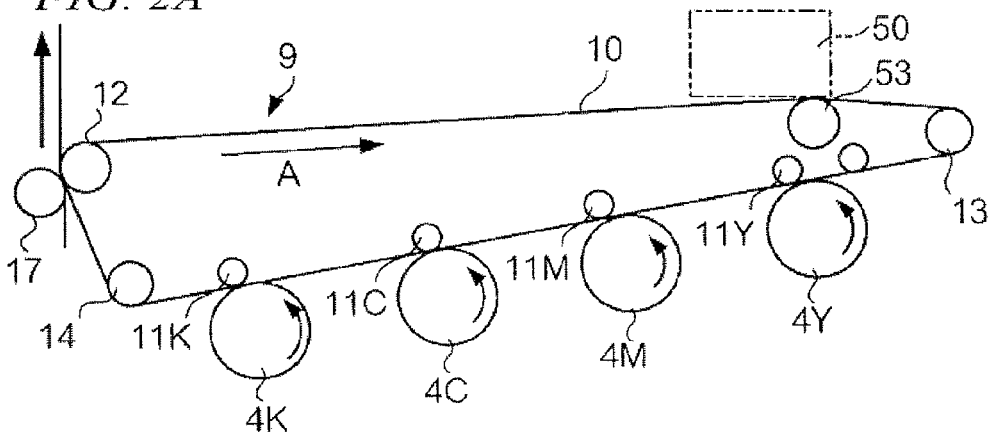
FIG. 2A and FIG. 2B are diagrams showing configurations of an intermediate transfer member in a color mode and in a monochromatic mode individually.

FIG. 2A is a diagram showing the configuration of intermediate transfer member 9 in the color mode. In the color mode, intermediate transfer belt 10 makes contact with all photoconductor drums 4, with the result that images are transferred from photoconductor drums 4 to intermediate transfer belt 10.

Figure 2B:
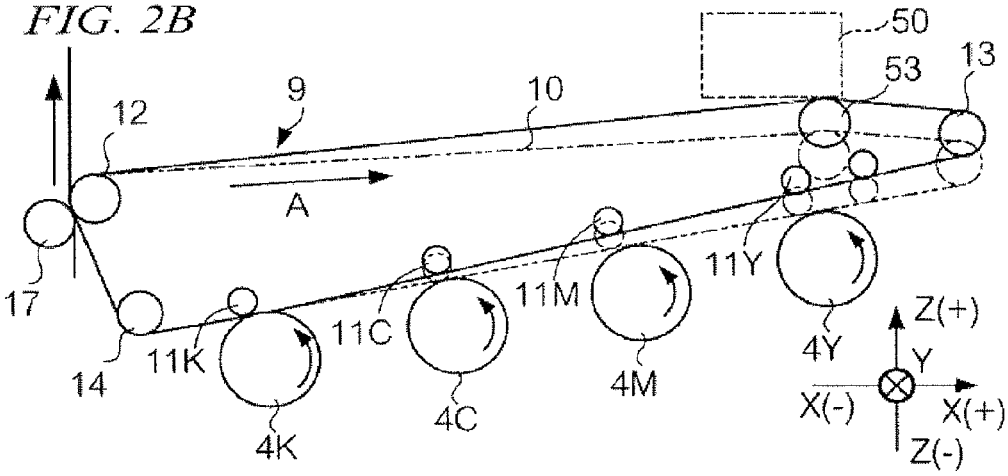

FIG. 2B is a diagram showing the configuration of intermediate transfer member 9 in the monochromatic mode. In the monochromatic mode, tension roller 13, first transfer rollers 11C, 11M, and 11Y, and a cleaner backup roller 53 (these rollers are referred to as a movable roller group hereinafter) are arranged in such a way that there are gaps between intermediate transfer belt 10 and photoconductor drums 4C, 4M, 4Y. As a result, only photoconductor drum 4K makes contact with intermediate transfer belt 10.

<Structure of Image-Forming Apparatus>

Figure 3:
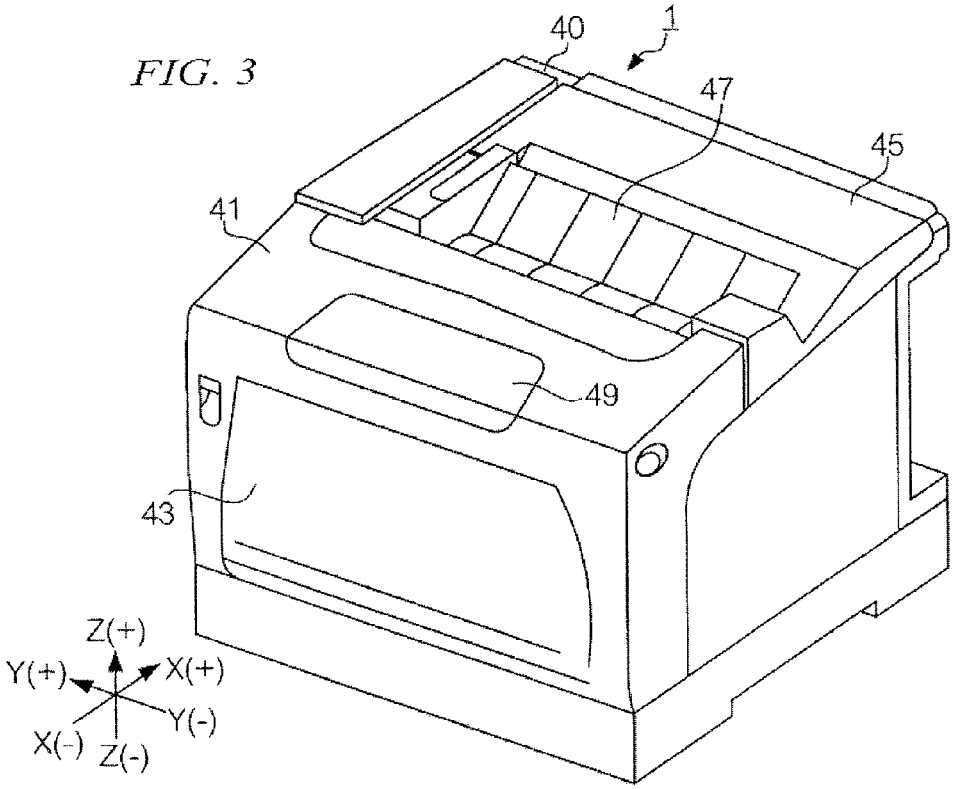
FIG. 3 is a perspective view showing an external view of the image-forming apparatus.
Figure 4:
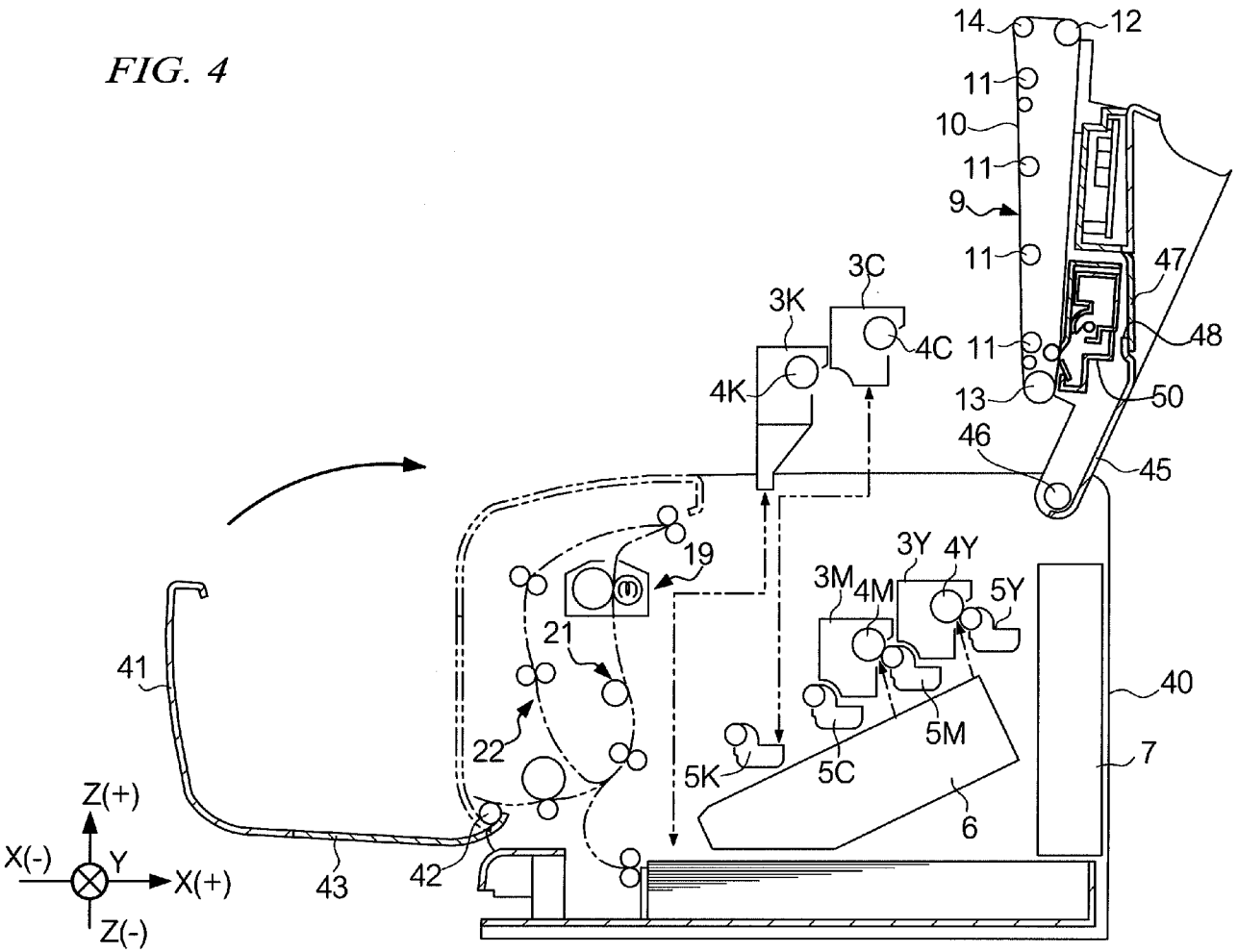
FIG. 4 is a diagram showing the image-forming apparatus with an opening/closing cover in an open position.

FIG. 3 is a perspective view showing an external view of image-forming apparatus 1. FIG. 4 is a diagram showing an internal configuration of image-forming apparatus 1 when an opening/closing cover 41 on the side surface and a cover 45 on the top surface of image-forming apparatus 1 are opened.

On the side surface of body 40 of image-forming apparatus 1 is installed opening/closing cover 41 that is opened or closed on a support shaft 42. In addition, this opening/closing cover 41 is provided with a feed opening/closing cover 43. Feed opening/closing cover 43 is usually closed relative to opening/closing cover 41, but when different types of recording sheets other than those of recording sheets stocked in a paper container 24 are required, feed opening/closing cover 43 is opened relative to opening/closing cover 41, and necessary recording sheets are fed along feeding route 21 through feed opening/closing cover 43.

In addition, cover 45 that is opened or closed on a support shaft 46 is provided on a top surface of body 40. A top surface of cover 45 serves as a sheet discharge section 23 to which recording sheets 18 on which toner images are formed are discharged. A mount/remove door 47 is attached to this cover 45 to expose a mount/remove opening 48. A toner recovery container 60, which is one example of a removable component, and will be described later, goes through this mount/remove opening 48 when a toner recovery container 60 is mounted on or removed from body 40. A mount/remove door 47 is a door that is opened to expose mount/remove opening 48 to enable the mount/remove operation. On the other hand, disposed on the edge of body 40 is operation unit 49 including a numeric keypad, by use of which a number of recording sheets to be used and the like are input.

Cover 45 is usually closed relative to body 40, and it is opened when photoconductor units 3Y, 3M, 3C, or 3K are mounted on or removed from body 40. To prevent intermediate transfer member 9 installed inside cover 45 from banging against opening/closing cover 41 when cover 45 is opened, opening/closing cover 41 is opened first relative to body 40 before cover 45 is opened. On the other hand, before opening/closing cover 41 is closed relative to body 40, cover 45 is closed first relative to body 40.

<Configuration of Toner Recovery Unit>

According to recent trends, image-forming apparatuses are being continually downsized. As shown in FIG. 1, for example, toner recovery unit 50 is disposed inside a space between intermediate transfer member 9 and cover 45, which is otherwise a dead space inside cover 45, which leads to downsizing of body 40.

The configuration of toner recovery unit 50 will be described with reference to FIG. 5 below. Firstly, only the operations of toner recovery container 60 in accordance with the opening/closing operation of mount/remove door 47 will be described, and shapes and configurations of other members will be described in detail later.

Toner recovery unit 50 has a long side that coincides with the direction Y, and includes a box-shaped removal device 51 having an opening in its top surface, toner recovery container 60 being removably disposed in this removal device 51. Toner recovery container 60 is removable from body 40, and is an example of a removable component that is operable in the state of being housed in this body 40. Removal device 51 removes toner remaining on the surface of intermediate transfer belt 10. The toner removed by this removal device 51 is accumulated in toner recovery container 60.

Toner recovery container 60 moves in conjunction with the opening/closing operation of mount/remove door 47 via a mounting unit 70 and a support member 85 (none of which is shown in FIG. 5). Mounting unit 70 and support member 85 will be described in detail later. Described concretely, when mount/remove door 47 is in the state of being closed, toner recovery container 60 moves to a first position (shown in FIG. 5A) in which image forming apparatus 1 is operative; in other words, toner recovery container 60 is operative. On the other hand, when mount/remove door 47 is in the state of being opened, toner recovery container 60 moves to a second position (shown in FIG. 5B) in which it becomes easier to mount or remove toner recovery container 60. In other words, toner recovery container 60 moves to the second position, which is nearer to an external space via mount/remove opening 48 than the first position. As a result, toner recovery container 60 in the second position can be mounted on or removed from removal device 51 as shown in FIG. 5C. In other words, in conjunction with the opening operation of mount/remove door 47, this toner recovery container 60 moves to the second position, so that toner recovery container 60 can be mounted in or removed from removal device 51. At the time of exchanging toner recovery container 60, a user of image-forming apparatus 1 removes toner recovery container 60 from removal device 51, and mounts an empty toner recovery container 60, that is, one that contains no toner, on removal device 51.

Removal device 51 has a scratch-up member 52 as shown in FIG. 5A. Cleaner backup roller 53 is disposed in such a way that it faces this scratch-up member 52 with intermediate transfer belt 10 therebetween. The width of scratch-up member 52 extending in the direction Y is set to be wider than the width of intermediate transfer belt 10. Scratch-up member 52 has contact with the outer peripheral surface of intermediate transfer belt 10 and scratches up toner attached to the outer peripheral surface, so that the toner removed from the outer peripheral surface is accumulated in a housing space in removal device 51. The housing space in removal device 51 leads to a toner-housing unit 62 in toner recovery container 60 via an aperture section 54. In addition, as shown in the exploded perspective view of FIG. 6, removal device 51 has an apparatus-side shutter 55 used for opening or closing the aperture section 54. When toner recovery container 60 is in the first position, apparatus-side shutter 55 opens aperture section 54, and when toner recovery container 60 is in the second position, apparatus-side shutter 55 closes aperture section 54.

Toner recovery container 60 has a long side, and contains toner-housing unit 62. Toner recovery container 60 is provided with an aperture section 61 that faces aperture section 54 in the state where toner recovery container 60 is mounted in removal device 51. The toner accumulated in removal device 51 is fed to toner housing unit 62 via aperture sections 54 and 61. Provided in toner housing unit 62 is a feeding member 63 that is rotated on a driving shaft 64. This feeding member 63 conveys the toner fed in the vicinity of aperture section 61 to the rear of toner housing unit 62. A gear 64A is attached to one end of driving shaft 64, and torque generated by a driving source in body 40 is transmitted to driving shaft 64 via this gear 64A. This driving shaft 64 is an example of a rotating member the direction of whose long side coincides with the direction of the long side of toner recovery container 60, and gear 64A is an example of a mechanism that rotates this rotating member (driving shaft 64).

In addition, toner recovery container 60 has a container-side shutter 65 for opening and closing aperture section 61. Container-side shutter 65 opens aperture section 61 when toner recovery container 60 is in the first position, and closes aperture section 61 when toner recovery container 60 is in the second position.

Figure 7A:
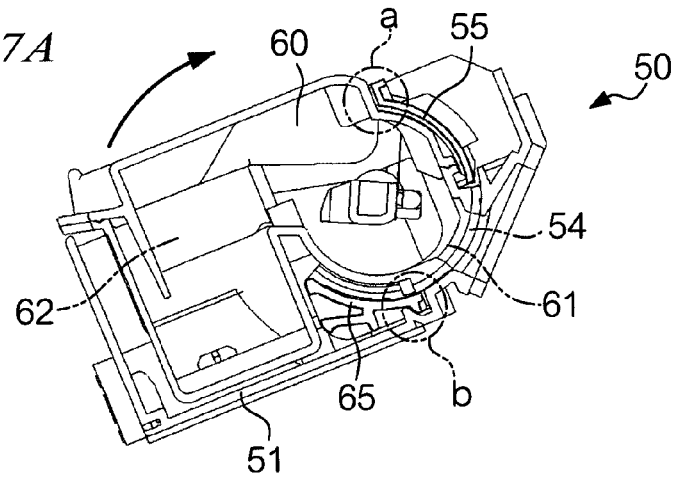
FIGS. 7A, 7B, and 7C are diagrams schematically showing operation states of shutters in association with a rotating movement of a toner recovery container.
Figure 7B:
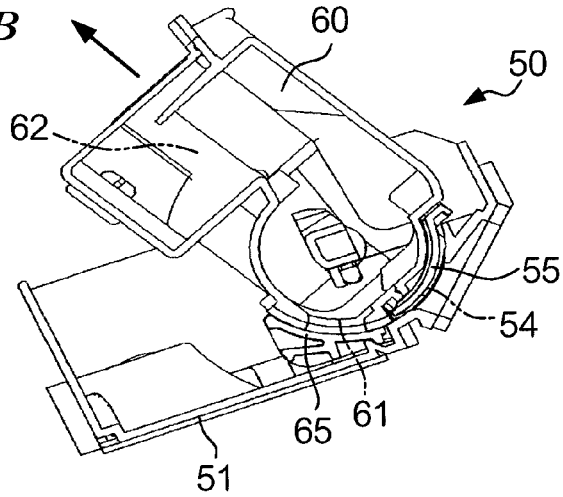
Figure 7B:
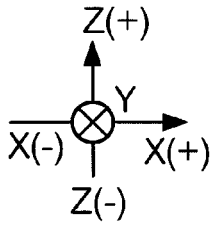
Figure 7C:
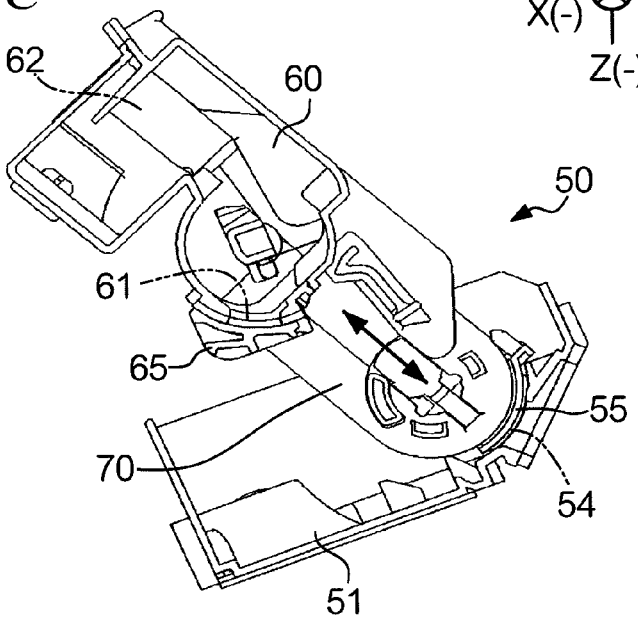

Here, operations of apparatus-side shutter 55 and container-side shutter 65 will be described. FIGS. 7A, 7B, and 7C are diagrams schematically showing operation states of shutters 55 and 65 in association with a mount/remove movement of toner recovery container 60. As shown in FIG. 7A, after being rotated in the direction indicated by an arrow relative to removal device 51 by a user, toner recovery container 60 is removed from removal device 51. As shown in FIG. 7A, in a state where toner recovery container 60 is in the first position or, in other words, toner recovery container 60 is in the state of being mounted on removal device 51, apparatus-side shutter 55 opens aperture section 54 and container-side shutter 65 opens aperture section 61, whereby the housing space in removal device 51 and toner housing unit 62 in toner recovery container 60 lead to each other via aperture sections 54 and 61 that are formed in such positions that they face each other. In this state, one end of apparatus-side shutter 55 that is positioned on the upstream side of the arrow is supported by a part of toner recovery container 60 (part marked by a), and one end of container-side shutter 65 that is positioned on the upstream side of the arrow is supported by a part of removal device 51 (part marked by b).

Next, as shown in FIG. 7*b*, in the state where toner recovery container 60 is in the second position after being rotated in the direction indicated by the arrow relative to removal device 51, apparatus-side shutter 55 closes aperture section 54 and container-side shutter 65 closes aperture section 61. In other words, apparatus-side shutter 55 that rotates in accordance with the rotation of toner recovery container 60 closes aperture section 54 of removal device 51, and container-side shutter 65 closes aperture section 61 of toner recovery container 60 that rotates in accordance with the rotation of toner recovery container 60. As a result, both aperture sections 54 and 61 are closed.

When toner recovery container 60 is separated from removal device 51, as shown in FIG. 7C, aperture section 61 of toner recovery container 60 is covered by container-side shutter 65, and aperture section 54 of removal device 51 is covered by apparatus-side shutter 55. As described above, because both aperture sections 61 and 54 are covered, neither toner inside container 60 nor toner inside device 51 is leaked outside, which prevents the inside of body 40 from being tainted with waste toner.

These apparatus-side shutter 55 and container-side shutter 65 are examples of doors that open aperture sections 54 and 61 respectively when toner recovery container 60 is in the first position, and close aperture sections 54 and 61 respectively when toner recovery container 60 is in the second position.

Next, mounting units 70 and 75 that connect removal device 51 and toner recovery container 60 will be described. These mounting units 70 and 75 are examples of mounting units on which toner recovery container 60 is mounted as a removable component. Mounting units 70 and 75 are attached to body 40.

Figure 6:
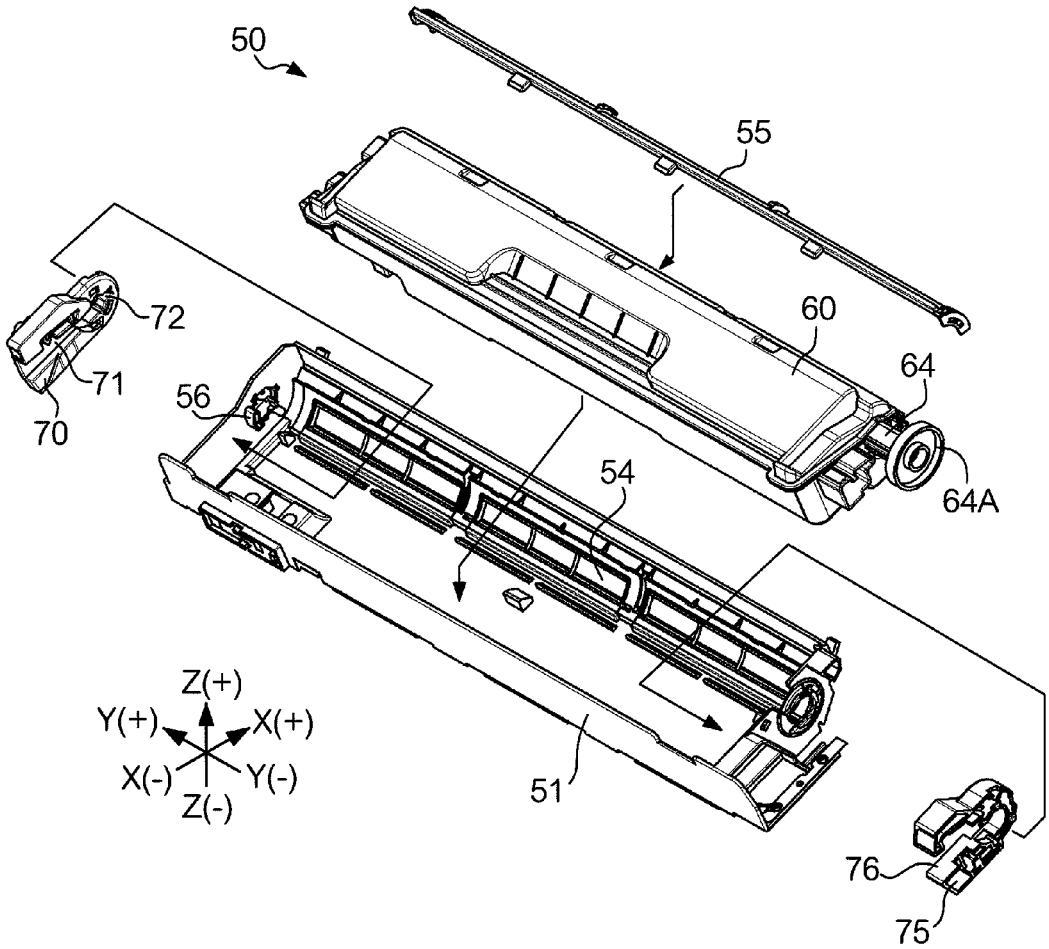
FIG. 6 is an exploded perspective view of the toner recovery unit.

As shown in FIG. 6, removable device 51 has a box-like shape with its long side extending in the direction Y. Two different shaped mounting units 70 and 75 are rotatably attached to the sides of both ends of the long side of removal device 51, respectively.

Formed in one mounting unit 70 is a groove 71 into which a side of toner recovery container 60 falls in order for toner recovery container 60 to be attached to mounting unit 70. In addition, formed in the rear of groove 71 is a support section 72 for rotatably supporting mounting unit 70 relative to removal device 51. Formed in the other mounting unit 75 is a U-shaped through-groove 76 into which a side of toner recovery container 60 and driving shaft 64 fall in order for the toner recovery container 60 to be attached to mounting unit 75. A member in the rear of through-groove 76 forms a support section for rotatably supporting mounting unit 75 relative to removal device 51 in cooperation with driving shaft 64.

Because toner recovery container 60 rotates relative to removal device 51 owing to the operations of these mounting units 70 and 75, toner recovery container 60 can move from the first position to the second position relative to removal device 51 and vice versa as shown in FIG. 5A to FIG. 5C, FIG. 6, and FIG. 7A to FIG. 7C.

In addition, mounting unit 70 is provided with a rotation control mechanism. This rotation control mechanism functions to prevent toner recovery container 60 from rotating unless the side of toner recovery container 60 properly falls into groove 71 of mounting unit 70.

Figure 8A:
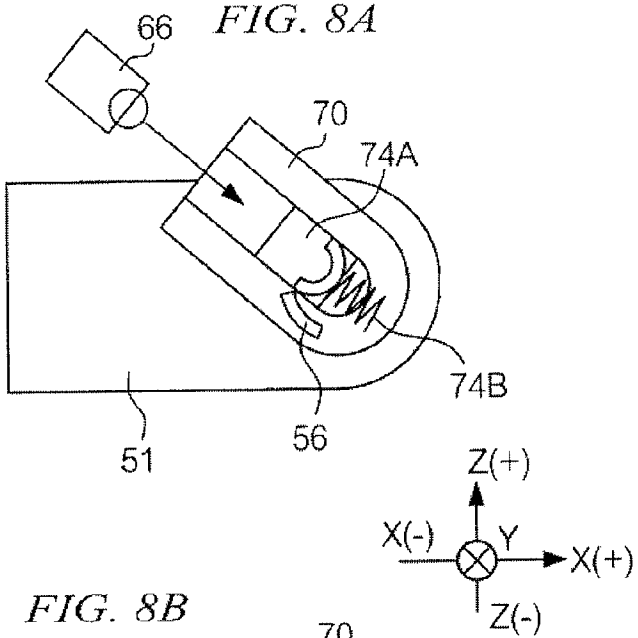
FIGS. 8A and 8B are diagrams schematically showing a control section for controlling the rotation of a mounting unit.
Figure 8B:
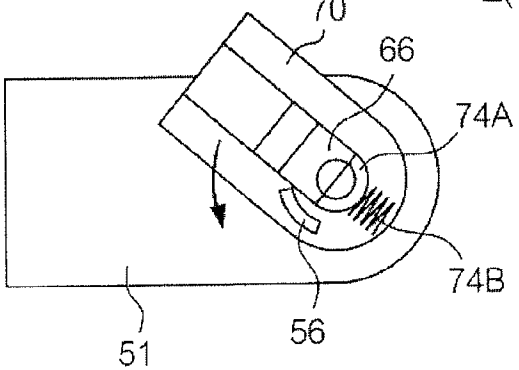

Described concretely, this rotation control mechanism is configured, for example, as shown in FIGS. 8A and 8B.

In removal device 51, formed in the position facing support section 72 of mounting unit 70 is a circular arc rib 56 that extends to mounting unit 70. In mounting unit 70, a reception section 74A is attached to a position whose y-coordinate is equivalent to that of circular arc rib 56 in such a way that reception section 74A can be moved in the direction indicated by an arrow in FIG. 8A. This reception section 74A is pushed out in the direction opposite to the direction indicated by the arrow in FIG. 8A by biasing force of a spring 74B. In this state, even if an attempt is made to rotate mounting unit 70 counterclockwise, mounting unit 70 is prevented from rotating because a side of reception section 74A makes contact with an end of rib 56.

On the other hand, if a positioning section 66 formed on a side of toner recovery container 60 is inserted into the rear of reception section 74A of mounting unit 70 against the biasing force of spring 74B, reception section 74A becomes detached from the end of rib 56, with the result that mounting unit 70 is allowed to rotate as shown in FIG. 8B. In this way, removal device 51 is configured so that mounting unit 70 does not rotate unless toner recovery container 60 is mounted in mounting unit 70. Because this mounting unit 70 rotates in conjunction with the opening/closing operation of mount/remove door 47, mount/remove door 47 is prevented from closing when toner recovery container 60 is not in the state of being mounted on mounting unit 70. In other words, the rotation control mechanism is one example of a control section for preventing mount/remove door 47 from closing when mount/remove door 47 is in the state of being opened and toner recovery container 60 is not in the state of being mounted on mounting unit 70.

Figure 9A:
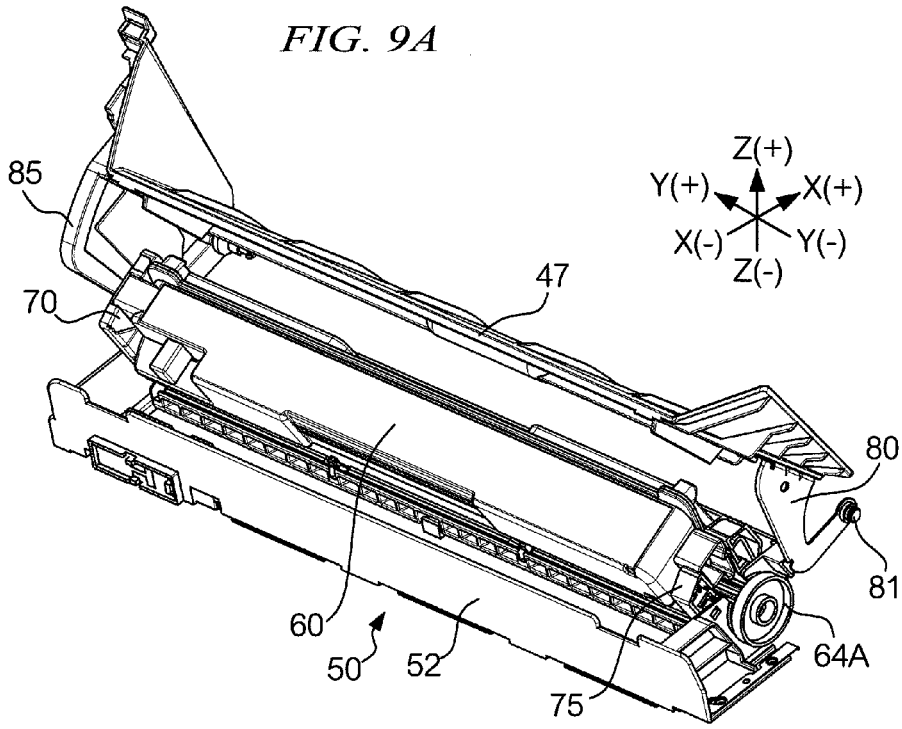
FIGS. 9A and 9B are perspective views showing a relation between a mount/remove door and the toner recovery unit when the toner recovery container is in the second position.
Figure 9B:
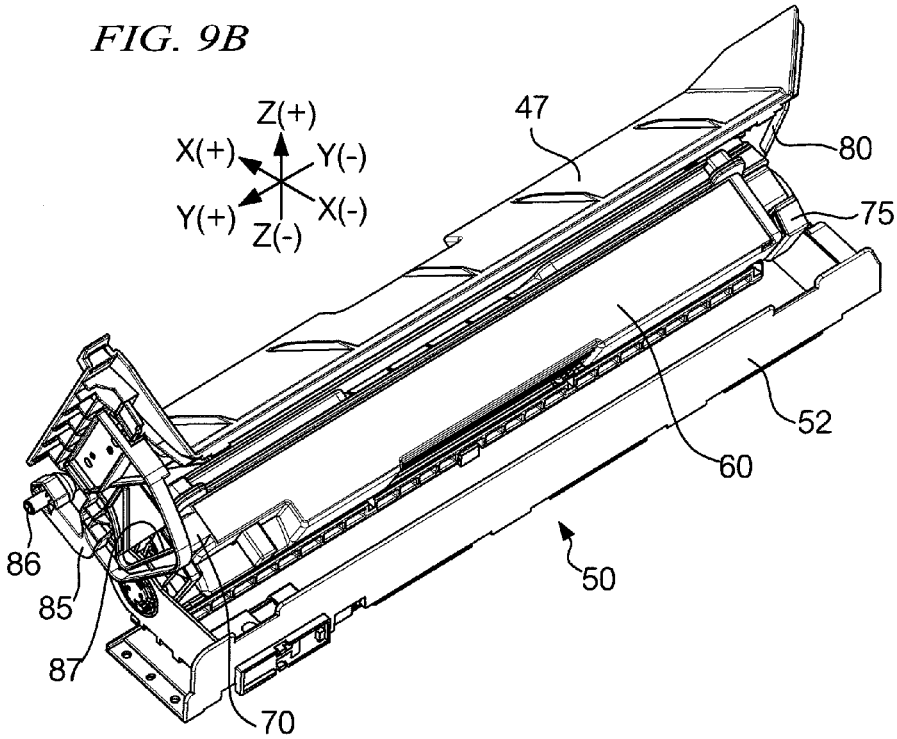

Next, description will be made about support members 80 and 85 that support mount/remove door 47 relative to body 40. FIGS. 9A and 9B are perspective views of toner recovery container 60 mounted between mounting units 70 and 75 in the case where toner recovery container 60 is located in the second position. These perspective views are used to describe a relationship between mount/remove door 47 and toner recovery unit 50.

In mount/remove door 47, support member 80 is disposed in the right direction (the direction Y(−)) from an anterior view in FIG. 9A or FIG. 9B. Formed on one end of this support member 80 is a support salient section 81 that is rotatably engaged with a support reception concave section (not shown) of body 40, and attached to the other end is one end of mount/remove door 47. In mount/remove door 47, support member 85 is disposed in the left direction (the direction Y(+)) from an anterior view in FIG. 9A or FIG. 9B. Formed on one end of this support member 85 is a support salient section 86 that is rotatably engaged with a support reception concave section (not shown) of body 40, and attached to the other end of support member 85 is the other end of mount/remove door 47.

The line that connects the support salient sections 81 and 86 coincides with a rotating shaft of mount/remove door 47, and mount/remove door 47 rotates on this rotating shaft.

In addition, an approximately L-shaped guide groove 87 is formed along the length of support member 85 from one end to the other end. A pin member 73 that is saliently formed is inserted into this guide groove 87 in the longitudinal direction (direction Y(+)) from mounting unit 70. Because mount/remove door 47 is connected to mounting unit 70 via this pin member 73, support member 85 can be said to be an example of a connecting member for connecting mount/remove door 47 and mounting unit 70. The moving direction of pin member 73, that is, the moving direction of toner recovery container 60 during the opening/closing operation of mount/remove door 47 is guided by movement of pin member 73 along guide groove 87. In other words, the position or attitude of mounting unit 70 is changed in accordance with the opening/closing operation of mount/remove door 47, with the result that toner recovery container 60 mounted in mounting unit 70 moves from the first position to the second position or vice versa. In this way, while support members 80 and 85 rotatably support mount/remove door 47, guide groove 87 formed in support member 85 (connecting member) can be said to be one example of a groove, and pin member 73 of mounting unit 70 inserted to this guide groove can be said to be one example of a protruding portion.

In the above-described configuration, mounting unit 70 can be more smoothly moved in accordance with the operation of mount/remove door 47 without disturbing rotations of rotating shaft 64 and gear 64A, than in a configuration in which mounting unit 70 and mount/remove door 47 are connected by use of a member other than support member 85 that supports mount/remove door 47. In addition, the above-described configuration can be composed of a smaller number of components. If members that support the door are utilized in connecting mounting unit 70 and mount/remove door 47, it becomes necessary to provide a space to house the members in the body, which in turn necessitates an apparatus of increased size, while the above-described configuration does not require that the size of the apparatus be increased.

In addition, the positional relation between support member 85 that serves as the connecting member and gear 64A is not limited to the above-described positional relation, and support member 85 and gear 64A can be freely disposed in consideration of disadvantages such as interference therebetween.

Figure 10:
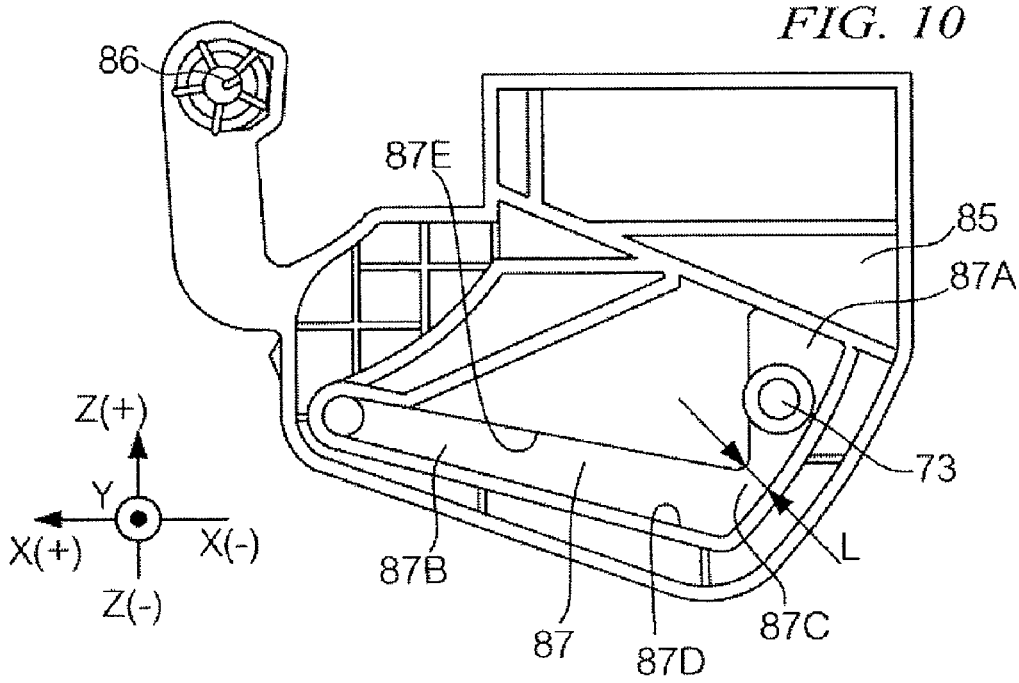
FIG. 10 is a plan view of the mounting unit.

FIG. 10 is a plan view of support member 85. A short portion 87A of guide groove 87A that extends in the vertical direction (the direction Z) is a portion that reduces an amount of pressure needed for pressing mount/remove door 47 (toner recovery container 60) into removal device 51. Long portion 87B that extends in the lateral direction (the direction X) controls an angle that mount/remove door 47 (toner recovery container 60) forms, and short portion 87A that extends in the vertical direction (the direction Z) serves as a buffer for absorbing a positional change between toner recovery container 60 and mount/remove door 47 in a state where toner recovery container 60 is in the first position. A part of short portion 87A that is located near to long portion 87B forms an embrasure 87C that is narrower than any embrasures that are formed by other parts of guide groove 87. The groove width of this embrasure 87C will hereinafter be represented by L (the groove width will be referred to as gap distance L hereinafter).

Gap distance L of this embrasure 87C is smaller than the diameter of pin member 73. Support members 80 and 85 are made of resin material, because the extent of deformation of the resin material is greater than that of, for example, metal material when physical force is applied. Therefore, force above a certain level applied to pin member 73 will cause pin member 73 to pass through embrasure 87C.

Hereinafter, Among surfaces of guide groove 87, a surface composed of a lower surface of long portion 87B formed in the down direction (in the direction Z(−)) and a right surface of short portion 87A in the right direction (in the direction X(−)) will be referred to as a first surface 87D, and a surface composed of a top surface of long portion 87B formed in the up direction (in the direction Z(+)) and a left surface of short portion 87A in the left direction (in the direction X(+)) will be referred to as a second surface 87E. When mount/remove door 47 is opened, pin member 73 of mounting unit 70 moves along first surface 87D, so that the position and attitude of mounting unit 70 are changed. On the other hand, when mount/remove door 47 is closed, pin member 73 of mounting unit 70 moves along second surface 87E, so that the position and attitude of mounting unit 70 are changed.

Because the other mounting unit 75 is provided with through-groove 76 through which driving shaft 64 is supported, only mounting unit 70 is connected to mount/remove door 47 via support member 85. Even in the above-described configuration, removal device 51 is attached to body 40 and mount/remove door 47 is rotatably supported relative to cover 45 by support members 70 and 75, so that mounting units 70 and 75 are not significantly deformed.

In addition, because support salient section 81 of support member 80 and support salient section 86 of support member 85 are individually provided with release parts such as springs (not shown), when a lock mechanism of mount/remove door 47 (not shown) is released, mount/remove door 47 (toner recovery container 60) is automatically opened owing to biasing forces of these release parts.

Figure 11A:
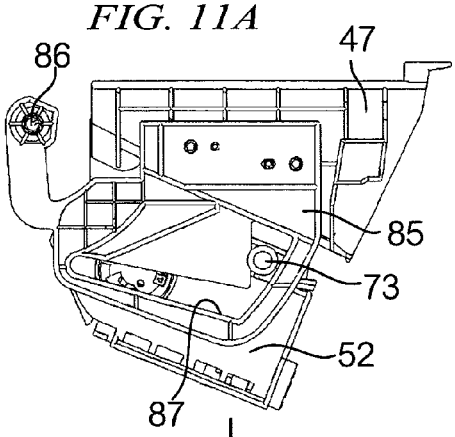
FIGS. 11A to 11F are diagrams showing operation states where the mount/remove door is opened.
Figure 11B:
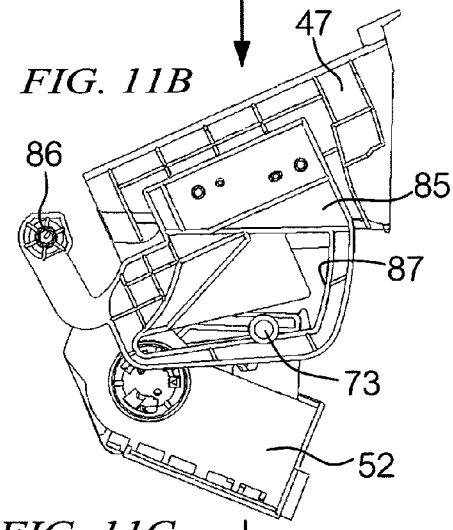
Figure 11C:
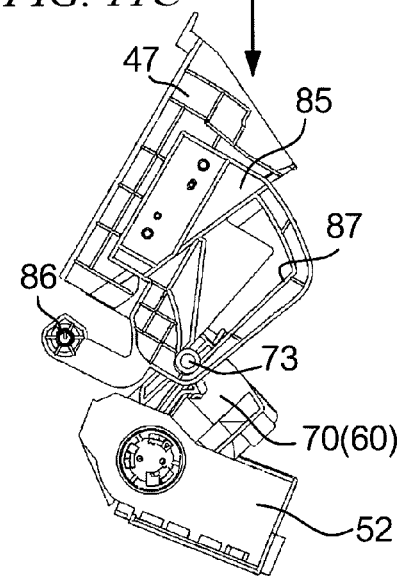
Figure 11D:
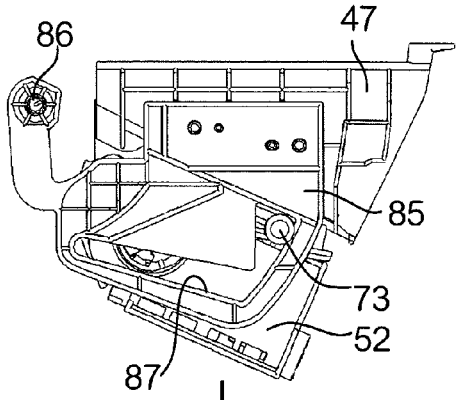
Figure 11E:
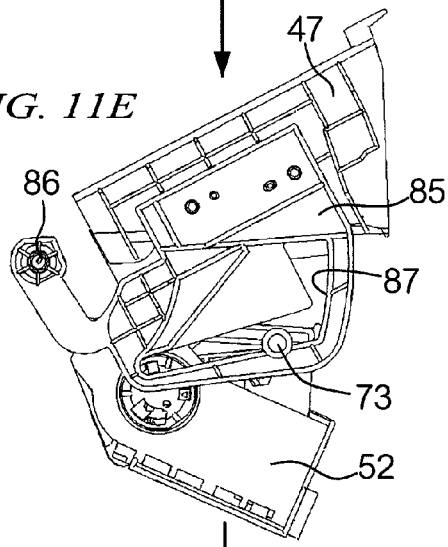

An operation of pin member 73 relative to guide groove 87 in accordance with the opening/closing operation of mount/remove door 47 will be described below. FIGS. 11A to 11F are diagrams showing operation states where mount/remove door 47 is opened. FIGS. 11A to 11C are diagrams showing operation states where intermediate transfer member 9 is in the color mode, while FIGS. 11D to 11E are diagrams showing the operation states where intermediate transfer member 9 is in the monochromatic mode. FIGS. 12A to 12F are diagrams showing operation states where mount/remove door 47 is closed. FIGS. 12A to 12C are diagrams showing the operation states where intermediate transfer member 9 is in the color mode, while FIGS. 12D to 12E are diagrams showing the operation states where intermediate transfer member 9 is in the monochromatic mode.

Figure 11F:
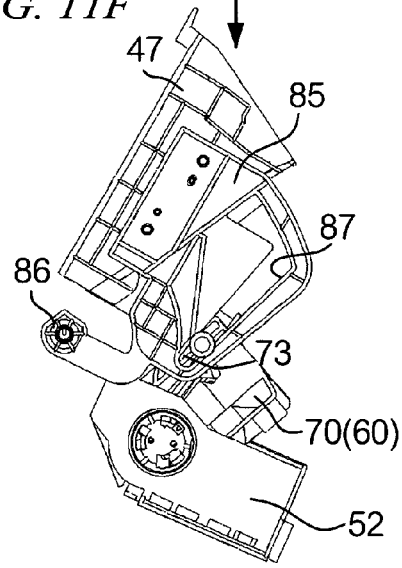
Figure 12A:
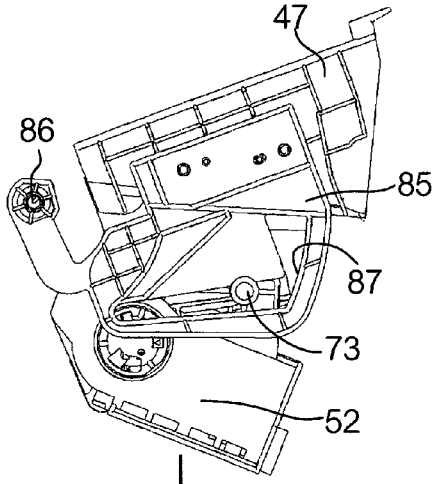
FIGS. 12A to 12F are diagrams showing operation states where the mount/remove door is closed.
Figure 12B:
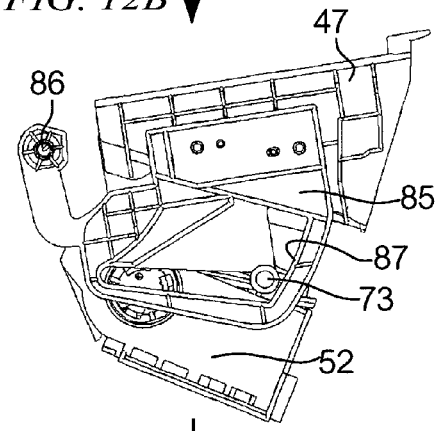
Figure 12C:
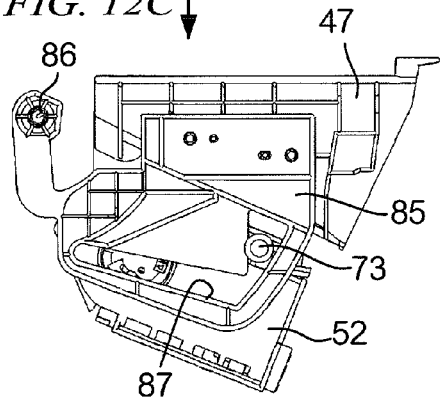
Figure 12D:
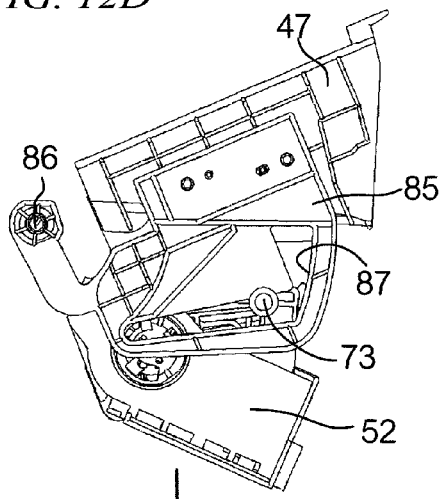
Figure 12E:
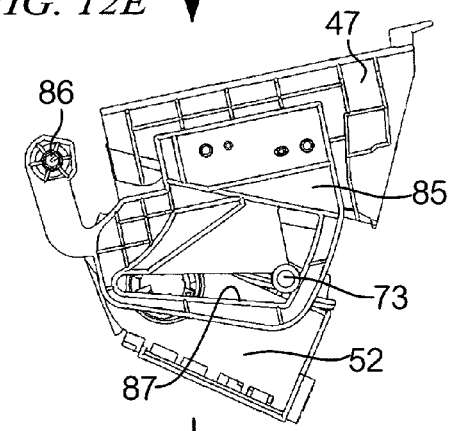

A difference between a group of FIGS. 11A to 11C and a group of FIGS. 11D to 11F is that the position of pin member 73 that is guided by guide groove 87 is different between FIG. 11A and FIG. 11D, between FIG. 11B and FIG. 11E, or FIG. 11C and FIG. 11F. The same is true of a difference between a group of FIGS. 12A to 12C and a group of FIGS. 12D to 12F. Described concretely, as shown in FIG. 2A, the right side of intermediate transfer member 9 (the side in the direction X(+)) is set to be lower in the color mode than in the monochromatic mode in order for all the photo-conductor drums to make contact with intermediate transfer belt 10, with the result that, when mount/remove door 47 is in the state of being closed, that is, when toner recovery container 60 is in the first position, the height of pin member 73 relative to short portion 87A is different between the color mode and the monochromatic mode. In other words, the position of pin member 73 in the color mode shown in FIG. 11A is lower in the vertical direction than in the monochromatic mode shown in FIG. 11D.

In addition, in image forming apparatus 1, as shown in FIG. 2A and FIG. 2B, when the color mode is changed to the monochromatic mode by the spacing section, the right side of intermediate transfer belt 10 moves up, so that toner recovery unit 50 also moves up in accordance with the moving-up of the right side of intermediate transfer belt 10. On the other hand, removal device 51 that moves in accordance with the movement of intermediate transfer belt 10 at the switching between the two modes is connected to support member 85 that is attached to body 40 via mounting unit 70. Therefore, in image-forming apparatus 1, because pin member 73 moves freely in triangle-shaped short portion 87A, the positional change of toner recovery unit 50 relative to body 40 owing to the switching between the two modes can be canceled.

As shown in FIG. 11, when the lock mechanism of mount/remove door 47 is released by a user to open mount/remove door 47, mount/remove door 47 is rotated in such a direction that opening of the door is assisted by the biasing forces of the springs that serve as the release parts. In this case, support member 85 begins to rotate counterclockwise on support salient section 86. Here, while moving along the top surface of long portion 87B formed in the up direction (in the direction Z(+)) included by first surface 87D (along the lower surface of long portion 87B formed in the down direction (in the direction Z(−)) included by first surface 87D), pin member 73 rotates toner recovery container 60 (mounting unit 70) so that toner recovery container 60 (mounting unit 70) is raised upward. In addition, in the state of mount/remove door 47 being opened as shown in FIG. 11C or FIG. 11F, because other mounting unit 75 located opposite to mounting unit 70 in the longitudinal direction of toner recovery container 60 is also rotated in conjunction with mounting unit 70, toner recovery container 60 is exposed to the outside via mount/remove opening 48 of cover 45 (Refer to FIG. 1). In other words, toner recovery container 60 is in the second position. In this state, toner recovery container 60 can be replaced with a new one as shown in FIG. 5B.

In addition, at the opening operation of mount/remove door 47, while mount/remove door 47 is rotated upward along with support member 85 owing to the biasing forces of the springs that serve as the release parts, the rotational movement of mounting unit 70 is determined on the basis of the position of pin member 73 that moves in guide groove 87 because gravity acts on mounting unit 70 and toner recovery container 60. In other words, when pin member 73 moves along guide groove 87 in accordance with the rotation of support member 85, pin member 73 moves along the lower surface of guide groove 87 from right to left to rotate mounting unit 70 in response to opening of mount/remove door 47.

Because toner recovery unit 50 in the monochromatic mode is located higher in the vertical direction than in the color mode, the position of pin member 73 (mounting unit 70) in the monochromatic mode is higher than in the color mode at the start of the opening operation of mount/remove door 47, that is, when mount/remove door 47 is in the state of being closed as shown in FIG. 11A and FIG. 11D. In addition, even at the end of the opening operation of mount/remove door 47, that is, when mount/remove door 47 is in the state of being opened, the position of pin member 73 (mounting unit 70) in the monochromatic mode is located higher than in the color mode as shown in FIG. 11C and FIG. 11F.

In other words, the position of pin member 73 at the start of the opening operation of mount/remove door 47 when pin member 73 starts to move along first surface 87D while making contact therewith, and that of pin member 73 at the end of the opening operation of mount/remove door 47 when pin member 73 stops moving in the monochromatic mode are different from those in the color mode.

On the other hand, at the closing operation of mount/remove door 47, mount/remove door 47 is pressed by the user against the biasing forces of the springs that serve as the release parts. In this case, while moving along the surface of long portion 87B included by second surface 87E, pin member 73 rotates toner recovery container 60 (mounting unit 70) so that toner recovery container 60 (mounting unit 70) is dragged down. When pin member 73 reaches embrasure 87C, pin member 73 cannot be passed through embrasure 87C until force above a certain level is applied to pin member 73, because the gap distance L is smaller than the diameter of pin member 73, with the result that pin member 73 is in a state of building up pressure for pushing mount/remove door 47 without being passed through embrasure 87C (Refer to FIGS. 12B and 12E).

The foregoing situation arises because, to pass pin member 73 through embrasure 87C, it is necessary for the user to apply force larger than that needed for moving pin member 73 along long portion 87B, if pin member 73 is passed through embrasure 87C, pin member 73 moves upward in a single movement along the short portion 87A. Therefore, when pin member 73 is passed through embrasure 87C, mounting unit 70 (toner recovery container 60) is also rotated downward in a single movement. As a result, even in the case of the color mode where toner recovery unit 50 is located lower than in the case of the monochromatic mode, toner recovery container 60 can be mounted on removal device 51 without fail.

In addition, after being passed through embrasure 87C, pin member 73 remains at the position corresponding to the color mode or the monochromatic mode in short portion 87A. Therefore, toner recovery container 60 is safely mounted at the first position in removal device 51 regardless of the mode of intermediate transfer member 9.

More specifically, in the state where the right side of intermediate transfer member 9 (the side in the direction X(+)) is set to be lower in the color mode than in the monochromatic mode, toner recovery unit 50 is set to be correspondingly lower. In this state, pin member 73 is pressed upward in a single movement to be passed from long portion 87B to short portion 87A by closing of mount/remove door 47 because the gap distance L of embrasure 87C is smaller than the diameter of pin member 73, with the result that, even in the case of the color mode where toner recovery unit 50 is located lower, toner recovery container 60 can be safely mounted in removal device 51.

Figure 12F:
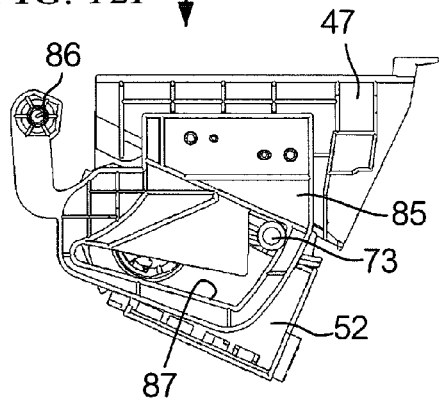

Even at the closing operation of mount/remove door 47, toner recovery unit 50 in the monochromatic mode is located higher than in the color mode in a similar way to the opening operation of mount/remove door 47. Therefore, at the start of the closing operation of mount/remove door 47, that is, when the door is in the state of being open, as shown in FIG. 12A and FIG. 12D, pin member 73 (mounting unit 70) in the monochromatic mode is located higher than in the color mode. In addition, even at the end of the closing operation of mount/remove door 47, that is, when the door is in the state of being closed, the position of pin member 73 (mounting unit 70) in the monochromatic mode is higher than in the color mode, as shown in FIG. 12C and FIG. 12F. In other words, the position of pin member 73 at the start of the closing operation of mount/remove door 47 when pin member 73 starts to move along second surface 87E while making contact therewith, and that of pin member 73 at the end of the closing operation of mount/remove door 47 when pin member 73 stops moving in the monochromatic mode are different from those in the color mode.

When the mode is switched from the color mode to the monochromatic mode, as shown in FIG. 2A and FIG. 2B, gaps are made between intermediate transfer belt 10 and photo-conductor drums 4C, 4M, 4Y. Therefore, if the rotation center of intermediate transfer belt 10 is located at photoconductor drum 4K for black color, the rotation center is located in the right side, as shown in FIG. 11A to FIG. 11F. Because intermediate transfer belt 10 with this rotation center is spaced from photoconductor drums 4C, 4M, 4Y in the monochromatic mode, pin member 73 moves upper right in accordance with this separation operation (Refer to FIG. 11A and FIG. 11D). In this way, by forming triangle-shaped short portion 87A, positional changes of pin member 73 are prevented from being transmitted to support member 85 via guide groove 87 and to mount/remove door 47 via mounting unit 70.

2. Modifications

The above-described exemplary embodiment can be modified as below.

In the above-described exemplary embodiment of the present invention, although mounting unit 70 disposed at one end of toner recovery container 60 is connected to mount/remove door 47 via support member 85, both of mounting unit 70 disposed at one end of toner recovery container 60 and mounting unit 75 disposed at the other end of toner recovery container 60 can be connected to mount/remove door 47 via support member 85 and via support member 80 respectively.

In the above-described exemplary embodiment, although toner recovery container 60 that recovers waste toner has been explained as an example of a replaceable target, the replaceable target is not limited to this toner recovery container 60, and toner supplying containers for supplying toner to developing devices 5Y, 5M, 5C, and 5K can be removal targets. Basically, in image forming apparatus 1, a part that is disposed at a location where the part can move between a first position and a second position in accordance with the opening/closing operation of mount/remove door 47, and that can be removed when in the second position, can be a removable component (a replaceable module).

In the above-described exemplary embodiment, although guide groove 87 is composed of short portion 87A and long portion 87B, and short portion 87A is triangle-shaped so as to cancel the positional change of pin member 73 owing to the switching between the two modes, the shape of short portion 87A is not limited to a triangle, and can be any other shape as long as pin member 73 moves along short portion 87A in accordance with the opening/closing operation of mount/remove door 47, and short portion 87A cancels the positional change of pin member 73 owing to the switching between the two modes and alleviates pressure for pressing pin member 73 into guide groove 87.

The foregoing description of the embodiments of the present invention is provided for the purposes of illustration and description. It is not intended to be exhaustive or to limit the invention to the precise forms disclosed. Obviously, a large number of possible modifications and variations will be apparent to practitioners skilled in the art. The embodiments were chosen and described in order to best explain the principles of the invention and its practical applications, thereby enabling others skilled in the art to understand the invention in various embodiments, and with the various modifications as suited to a particular use that may be contemplated. It is thus intended that the scope of the invention be defined by the following claims and their equivalents.

What is claimed is:

1. An image-forming apparatus comprising:

a body having a mount/remove opening;

a removable component that can be mounted on or removed from the body via the mount/remove opening, the removable component being operable when mounted on the body;

a door attached to the mount/remove opening;

a mounting unit on which the removable component is mounted, the mounting unit being attached to the body;

a connecting member that connects the door and the mounting unit, changes at least one of a position and attitude of the mounting unit in accordance with an opening/closing operation of the door, causes the removable component mounted on the mounting unit to move to a first position in which the removable component is operable when the door is closed, and causes the removable component mounted on the mounting unit to move to a second position, which is more easily accessible from an external space via the mount/remove opening than the first position, when the door is opened.

2. The image-forming apparatus according to claim 1, wherein:

the removable component comprises:

a container that has a first side and a second side in an opposing position to the first side and includes an inner space that houses toner;

a rotating member disposed in the inner space, that extends from the first side to the second side; and a mechanism disposed at the first side, that causes the rotating member to rotate, the door opens or closes by rotating on a shaft; and the connecting member rotatably supports the door and is disposed at the second side.

3. The image-forming apparatus according to claim 1, further comprising:

a protruding portion formed in the mounting unit; and a groove formed in the connecting member, into which groove the protruding portion is inserted, wherein the protruding portion moves along the groove in accordance with movement of the groove caused by the opening/closing operation thus altering the position or attitude of the mounting unit.

4. The image-forming apparatus according to claim 3, further comprising:

a transfer belt;

a plurality of image-forming units that form electrostatic latent images on image holding members individually, develop the electrostatic latent images individually using a variety of color developing agents, and transfer the developed images to the transfer belt; and a spacing section that moves a position of the transfer belt thus making gaps between some of the image holding members and the transfer belt, wherein:

the removable component is arranged at an opposite side of the transfer belt with respect to the image holding members; and the groove includes:

a portion having a width such that the protruding portion is able to move from a position of the protruding portion when the gaps are present to a position of the protruding portion when the image holding members abut the transfer belt;

a first surface that changes the position or attitude of the mounting unit by making contact with the protruding portion of the mounting unit when the door is opened; and a second surface that changes the position or attitude of the mounting unit by making contact with the protruding portion of the mounting unit when the door is closed.

5. The image-forming apparatus according to claim 3, further comprising a transfer belt to which developed images are transferred, wherein the groove includes a portion whose width is narrower than a width of the protruding portion, and the removable component moves nearer to the transfer belt in accordance with the protruding portion passing through the portion after making contact with the portion when the door is closed.

6. The image-forming apparatus according to claim 1, further comprising a locking mechanism that prevents the door from being closed if the door is being opened and the removable component is not being mounted on the mounting unit.

7. The image-forming apparatus according to claim 1, wherein the removable component is a toner supplying container that supplies toner to a developing unit.

8. The image-forming apparatus according to claim 1, wherein the removable component is a toner collection container that collects toner after the toner is used in a developing device.

9. The image-forming apparatus according to claim 1, wherein:

an aperture is formed in each of the removable component and the body, the aperture facing each other when the removable component is being mounted on the mounting unit; and a mechanism is provided in the image-forming apparatus, by which the two apertures are opened when the removable component is located at the first position, and by which the two apertures are closed when the removable component is located at the second position.

* * * * *